US006357725B2

(12) United States Patent
Nomura et al.

(10) Patent No.: US 6,357,725 B2
(45) Date of Patent: Mar. 19, 2002

(54) GAS/LIQUID MIXING DEVICE

(76) Inventors: Shinnosuke Nomura; Yousuke Nomura, both of c/o Nomura Electronics Co., Ltd., 279-26, Hino 3-chome, Daito-shi, Osaka (JP)

( * ) Notice: Subject to any disclaimer, the term of this patent is extended or adjusted under 35 U.S.C. 154(b) by 0 days.

(21) Appl. No.: 09/826,828

(22) Filed: Apr. 6, 2001

Related U.S. Application Data

(63) Continuation-in-part of application No. 09/439,287, filed on Nov. 15, 1999, now abandoned.

(30) Foreign Application Priority Data

Jul. 30, 1999 (JP) ..... 11-217078

(51) Int. Cl.[7] ..... B01F 3/04

(52) U.S. Cl. ..... 261/5; 261/91; 261/93; 261/122.1

(58) Field of Search ..... 261/91, 93, 121.1, 261/122.1, 5, 6

(56) References Cited

U.S. PATENT DOCUMENTS

| | | | | |
|---|---|---|---|---|
| 366,991 A | 7/1887 | Andrews | ..... | 261/93 |
| 2,590,581 A | 3/1952 | Shirley | ..... | 261/93 |
| 2,863,653 A | 12/1958 | Cummings | ..... | 261/93 |
| 2,865,618 A | 12/1958 | Abell | ..... | 261/93 |
| 3,779,631 A | 12/1973 | White | ..... | 261/93 |
| 3,962,042 A | 6/1976 | Malick | ..... | 261/93 |
| 4,166,086 A | 8/1979 | Wright | ..... | 261/93 |
| 4,341,641 A | 7/1982 | Novak | ..... | 261/93 |
| 5,366,698 A | 11/1994 | Smith et al. | ..... | 261/93 |
| 5,674,433 A | 10/1997 | Semmens et al. | ..... | 261/93 |

*Primary Examiner*—C. Scott Bushey
(74) *Attorney, Agent, or Firm*—Wenderoth, Lind & Ponack, L.L.P.

(57) ABSTRACT

A gas/liquid mixing device is provided in which bubbles having such a small diameter as to be invisible to the eye are produced and dissolved in water in a short time, whereby the solubility of gas can be improved. The gas/liquid mixing device has a mixing cylinder, a drive unit, and a gas supply device. In the mixing cylinder, a rotary vane having guide vanes is rotated to compress water in the mixing cylinder and gas supplied into the mixing cylinder so that the water flow containing the bubbles is dispersed outwardly through bubble dispersing holes formed in the wall of the mixing cylinder.

10 Claims, 6 Drawing Sheets

GAS/LIQUID MIXING DEVICE

This application is a Continuation-In-Part application of application Ser. No. 09/439,287, Nov. 15, 1999, now abandoned.

BACKGROUND OF THE INVENTION

This invention relates to a gas/liquid mixing device for keeping a gas such as air or ozone for a long time in liquid such as water as innumerable atomized bubbles by mixing and dissolving it in water.

When a gas such as oxygen or ozone is mixed and dissolved in water, water is activated by oxygen, the water quality improves, and polluted water is purified. Ozone water in which ozone is dissolved is usable for sterilization, deodorization, and keeping freshness. Thus various trials have been made to dissolve these gases at high concentrations. To dissolve such gases, heretofore, an arrangement in which gas is atomized and mixed using an injection nozzle is mainly used.

As an example of a device for dissolving oxygen in water, a bubble generator disclosed by unexamined Japanese patent publication 4-126542 is known. This bubble generator has a cylindrical body having one end closed and the other end open, an opening for introducing liquid into the cylindrical body in a tangential direction, and an opening at the closed end for introducing gas at the central position of the cylindrical body. Into the mixing chamber defined in the cylindrical body, liquid flows in a swirling state to draw gas from the opening for drawing external air under the suction force produced near the center of the flow of liquid. Colliding hard against the liquid flow, the gas turns into microscopic bubbles and is mixed in the flow of liquid.

As an example of an air mixing device for producing ozone water, a gas contact device and an ozone water generator are known from unexamined Japanese patent publication 5-123554. An ejector type nozzle which is a main part of this device has a liquid nozzle at the center. Through a suction gas chamber provided therearound, gas is drawn under negative pressure due to discharged flow of liquid, and discharged as bubbles through a gas discharge hole formed in a gas nozzle member (cap) at the tip of the nozzle.

When oxygen or ozone gas is dissolved in water, using the above-described nozzle type gas/liquid mixing device, they try to form bubbles having as small a diameter as possible and mix them in water to dissolve gas in the water. But with the nozzle type, forming bubbles having such a diameter that they are visible to the eye is the limit. Since such bubbles are large in buoyancy, even when mixed in water, they soon float up and disappear, so that they cannot remain in water for a long time.

Especially when ozone water is produced by a gas/liquid mixing device, solubility of ozone varies markedly with temperatures. For example, compared with 10° C. water, for 30° C. water, it decreases markedly to half, and it decreases in summer, when people want to use ozone water for sterilization and deodorization. Ozone that does not dissolve in water is released into the atmosphere as waste ozone. When such waste ozone is released into the atmosphere in large amounts, it will have a negative influence on the work environment. Thus, in producing ozone water in such a conventional gas/liquid mixing device, a device for disposing of waste ozone, using e.g. using a catalyst is needed.

An object of this invention is to provide a gas/liquid mixing device in which bubbles having such a small diameter as to be invisible are produced and dissolved in water in a short time, whereby the solubility of gas can be improved greatly.

SUMMARY OF THE INVENTION

According to this invention, there is provided a gas/liquid mixing device comprising a mixing cylinder submerged in liquid for mixing liquid with gas, and a gas supply means for supplying gas into the mixing cylinder, a mixing/compressing means provided in the mixing cylinder for compressing a gas/liquid mixture, a driving unit coupled to the mixing/compressing means for driving it, the gas supply means having a gas supply port in the mixing cylinder, and a bubble dispersing area provided for a predetermined length and at a predetermined distance from the mixing/compressing means. The mixing cylinder is formed with a plurality of holes in its peripheral wall at the bubble dispersing area, whereby the gas is mixed in liquid in the form of bubbles, and the bubbles are sufficiently compressed and atomized by the mixing/compressing means and are discharged through the holes out of the mixing cylinder.

Other features and objects of the present invention will become apparent from the following description made with reference to the accompanying drawings, in which:

DETAILED DESCRIPTION OF THE PREFERRED EMBODIMENT

Figure 1:
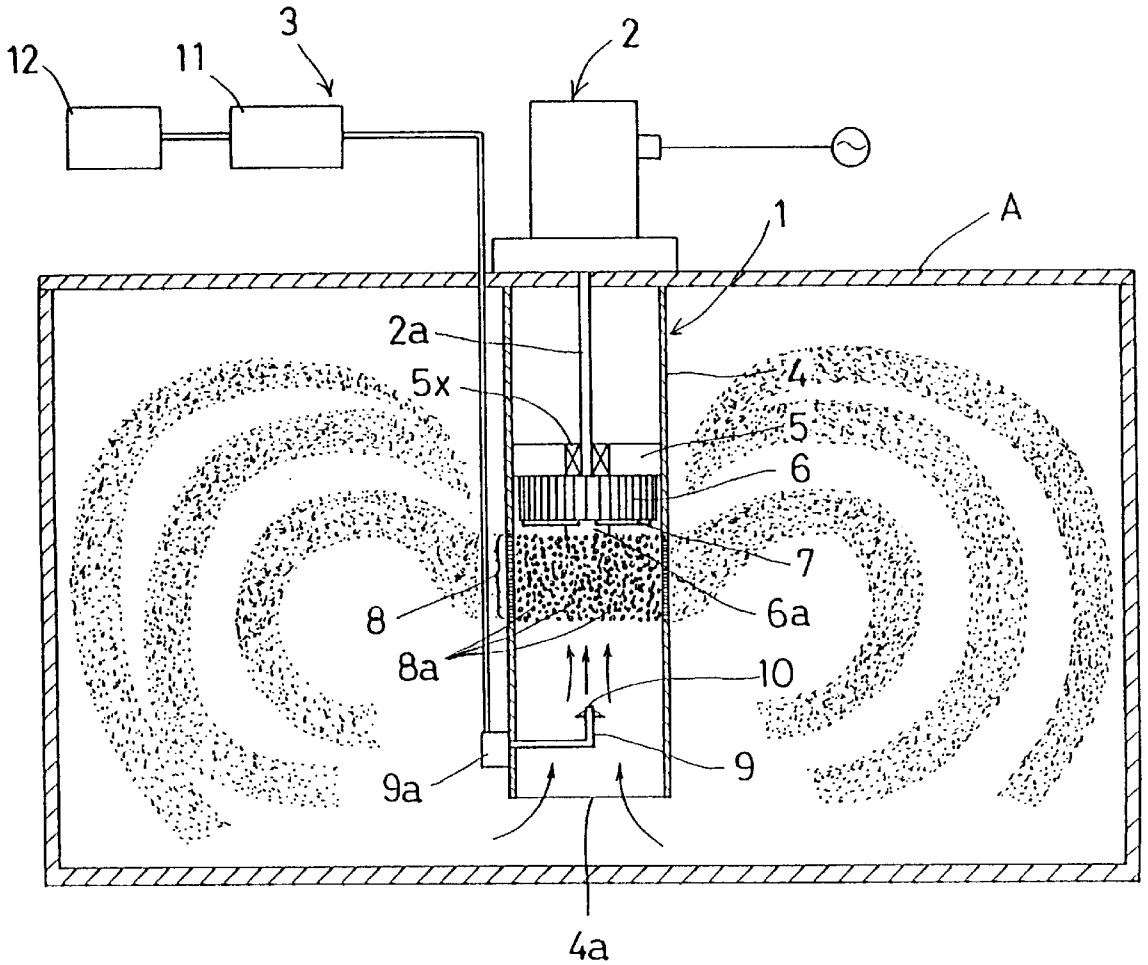
FIG. 1 is a sectional view of a gas/liquid mixing device of a first embodiment.

Embodiments of this invention are described with reference to the drawings. Referring to FIG. 1, the gas/liquid mixing device 1 has a gas/liquid mixing cylinder 4, a drive unit 2 and a gas supply means 3. In this embodiment, it is submerged in a water tank A. The gas/liquid mixing device 1 has a rotary vane 6 as a mixing/compressing means provided in a mixing cylinder 4 which is a hollow cylinder (10–15 cm in diameter in the embodiment). A multiplicity of small bubble dispersing holes 8*a* are provided at a bubble dispersing area 8 of the mixing cylinder 4 to disperse bubbles.

The rotary vane 6 is mounted on a mounting seat 5 provided at an intermediate position of the gas/liquid mixing cylinder 4, and is coupled to and driven by an output shaft 2*a* of a motor in a drive unit 2 which is supported through a bearing 5*x*. On the bottom end face of a rotor of the rotary vane 6, guide vanes 7 are provided. Gas/liquid mixture flow is moved in a radial direction by the guide vanes 7 to mix and compress gas/liquid mixture between it and the inner wall of the mixing cylinder 4. The guide vanes 7 are, in the embodiment, formed by crossing straight bars having a rectangular section. The guide vanes 7 may be provided in a curved manner if they can mix and compress gas and liquid.

Figure 2:
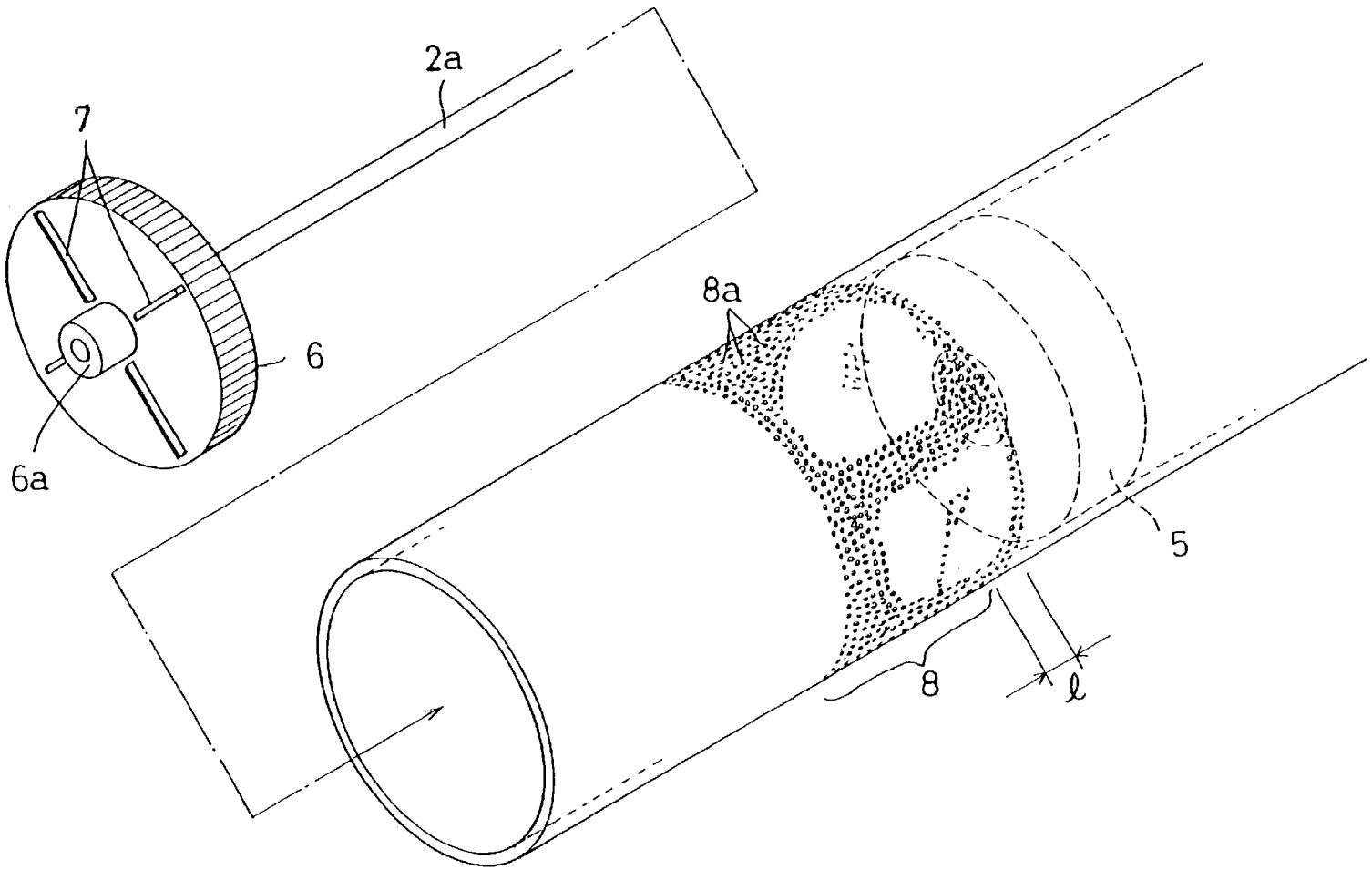
FIG. 2 is a partial exploded perspective view of the same.

The gas/liquid dispersing area 8 is formed in a predetermined distance range (4–5 cm in this example) starting from a position about 5–10 mm below the bottom end of the rotary vane 6 (FIG. 2). A multiplicity of bubble dispersing holes 8*a* are provided in a random arrangement in this area so that bubbles can be released outwardly from the mixing cylinder 4. For the size of the bubble dispersing holes 8*a*, they have a diameter of about 1 mm in the embodiment.

The gas supply means 3 has a gas supply pipe 9 provided near an opening 4*a* at the bottom end of the mixing cylinder 4. An opening 10 at its tip is open toward the rotary vane 6. The gas supply pipe 9 is connected to external piping through a connecting end 9*a*. In this embodiment, ozone is supplied from an ozone generator 11. Number 12 is an air pump for feeding air. Incidentally, the gas supplied may be air. In this case, the ozone generator 11 is not necessary. You have only to feed air directly into the air supply pipe 9 from the air pump 12.

The gas/liquid mixing device, as shown in FIG. 1, is used erected in water such as in a water tank A. When the rotary vane 6 is rotated by activating the motor in the drive unit 2 (the rotating direction may be normal or reverse), a water flow is moved radially by the guide vanes 7. By this movement of the water flow, water and gas (ozone or air) are drawn axially upwardly from the opening 4*a* at the bottom end of the mixing cylinder 4.

The water and gas that have been drawn move toward the rotary vane 6 in a spiral form while being mixed together and forming bubbles. The water flow containing bubbles is moved radially by the rotary vane 6 and further mixed and compressed by violently colliding against the inner wall of the mixing cylinder 4. Then the water flow is moved downwardly along the inner wall of the mixing cylinder 4. There is a dead zone where no bubble dispersing holes 8*a* are formed by a distance l between the bottom end of the rotary vane 6 and the top end of the bubble dispersing area 8.

Because the water flow deflected radially by the rotary vane 6 collides against the inner wall of the mixing cylinder 4, the degree of mixing and compression increases. If there were bubble dispersing holes 8*a* in this dead zone, bubbles would directly escape therethrough to the outside. Such bubbles would go out in immature large-diameter bubble particles with uneven diameters due to insufficient mixing/compression. But this is prevented by the formation of the dead zone not provided with bubble dispersing holes 8*a*. Also, relatively large bubbles are drawn into the swirling flow in the dead zone, to the central portion of the rotary vane and recompressed.

When a water flow containing bubbles atomized by the mixing/compressing function of the rotary vane 6 moves downwardly, while being still subjected to radial compressive force, part of the water flow passes together with bubbles through the bubble dispersing holes 8*a* in the peripheral wall while moving along the bubble dispersing area 8, and is dispersed into outside water. Mixed water compressed by the rotary vane and the side wall (at dead zone) is suddenly released into water facing the atmosphere, thereby forming microscopic particles.

The range of the bubble dispersing area 8 in which the dispersion of bubbles sufficiently occurs through the bubble dispersing holes 8*a*, which depends on the downwardly moving speed of the water flow, may be determined by experiments based on the rotating speed of the rotary vane 6. After bubbles have been sufficiently dispersed to the outside while passing through the bubble dispersing area 8, the water flow loses its momentum of flow, and it circulates together with the water flow drawn in through the bottom end opening 4*a* of the mixing cylinder 4.

The atomized microscopic bubbles will have uniform particle diameters of from several to several tens of microns and not exceeding 100 microns. Since the bubbles are ultrafine, they dissolve in water in a short time. Even when suspended in water, they become clouded, and remain in water. The particle size is so small that they remain in the water for a long time without floating upwardly by buoyancy. In the test, an ozone-oxygen mixture whose ozone concentration was 400 mg was supplied at a rate of 5 liter per minute and an ozone-containing water was fed under pressure at the rate of 50 liter/min, clouded, atomized bubbles were produced.

When bubbles remain in water for a long time in a clouded state, if the bubbles are air, they dissolve gradually into water, contributing to the activation of water. Also, atomized bubbles cultivate aerobic microorganisms in the water by directly adhering to the microorganisms, thus contributing to purification of the pollution of water. Also, if the bubbles are ozone, the ozone gradually dissolves in water and becomes ozone water further higher in concentration. Also, since ozone bubbles adhere directly to objects, as well as the effect as high-concentration ozone water, sterilizing and deodorizing effects increase markedly by the direct action of ozone bubbles.

Incidentally, no disposal of waste ozone is necessary. Even if a small amount of microscopic bubbles rise onto the water surface, they will soon become oxygen ($O_2$), so that ozone is not dispersed into the atmosphere, or ozone smell will be extremely scarce. Also, since microscopic particles float like lye on the water surface, when observed enlarged, bubbles look oval rather than circular because the surface tension of the water and the buoyancy of the bubbles balance.

Using the gas/liquid mixing device of the above embodiment as a device for producing ozone water, an experiment was conducted in which salmonella were immersed in ozone water. Before immersion, there existed $1.1\times10^3$ salmonella. When immersed in ozone water, after five minutes, the number of salmonella reduced to zero. Thus, it was confirmed that ozone has a strong sterilizing effect. As a control, an experiment was carried out in which ozone water produced by a conventional nozzle type gas/liquid mixing device was used. Even after 10 minutes, out of the initial $1.3\times10^3$ salmonella, $2.5\times10^2$ survived.

Figure 3:
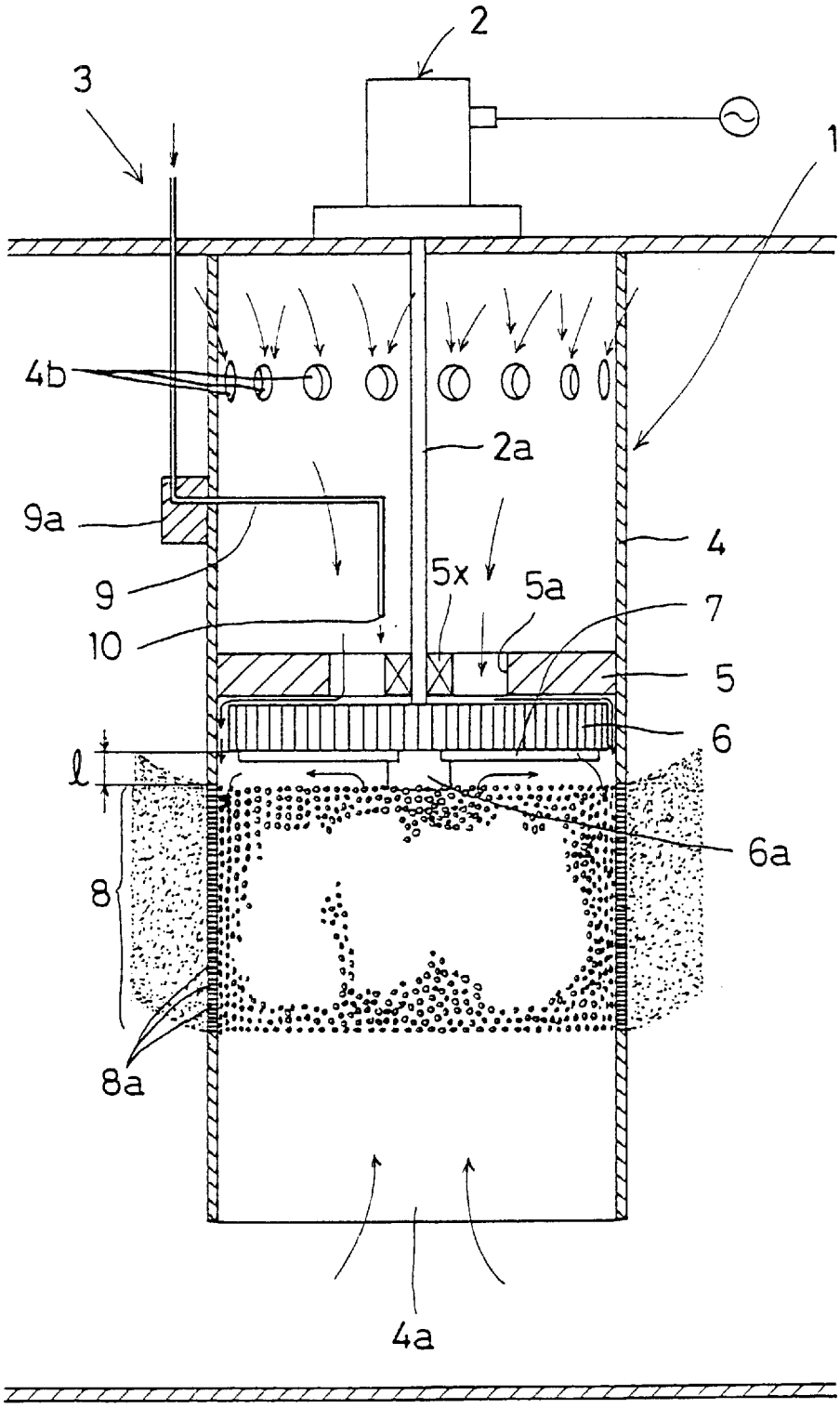
FIG. 3 is a sectional view of a second embodiment.

In FIG. 3, a sectional view of a gas/liquid mixing device of a second embodiment is shown. This embodiment differs from the first embodiment in that the air supply pipe 9 of the gas supply means 3 and its tip opening 10 are provided above the rotary vane 6, that communicating holes 5*a* are provided at a plurality of locations around the bearing 5*x* of the mounting seat 5, and that a plurality of water passing holes 4*b* are formed near the top end of the mixing cylinder 4. Other structures are basically the same as in the first embodiment. For the same structural members, the same numerals are used and the description is omitted.

The operation of the gas/liquid mixing device of this second embodiment is as follows. It is the same as in the first embodiment in that when the rotary vane 6 is rotated, water is drawn axially upwardly from the bottom end opening 4*a* of the mixing cylinder 4, and the flowing water moves radially and is compressed by colliding against the inner wall of the mixing cylinder 4. But gas is supplied from the gas supply pipe 9 above the mounting seat 5, and is mixed into water as bubbles. Also, into the mixing cylinder 4, water flows through the water passing holes 4*b*. When a flow forms in the water, it flows into the communicating holes 5*a* around the bearing 5*x* together with bubbles.

Between the mounting seat 5 and the rotary vane 6 and between the rotary vane 6 and the mixing cylinder 4, predetermined gaps are defined, respectively. When the rotary vane 6 rotates, a water flow from under the mixing cylinder 4 is compressed by the guide vanes 7 and flows downwardly along the inner wall of the mixing cylinder. By this water flow, a water flow containing bubbles that has flown into the communicating holes 5*a* is drawn in, and similarly flows downwardly.

The water flow containing bubbles merges with the water flow compressed by the rotation of the rotary vane 6, and is subjected to compressing action. Bubbles are thus atomized into small particles and flow downwardly. When this flow reaches the bubble dispersing area 8, bubbles flow out through the gas/liquid dispersing holes 8*a* in the peripheral wall, and are mixed and dispersed in water around the device. In this embodiment too, bubbles are in an atomized state, and clouded, mixed and dispersed, so that they remain in water over a long period of time.

Figure 4:
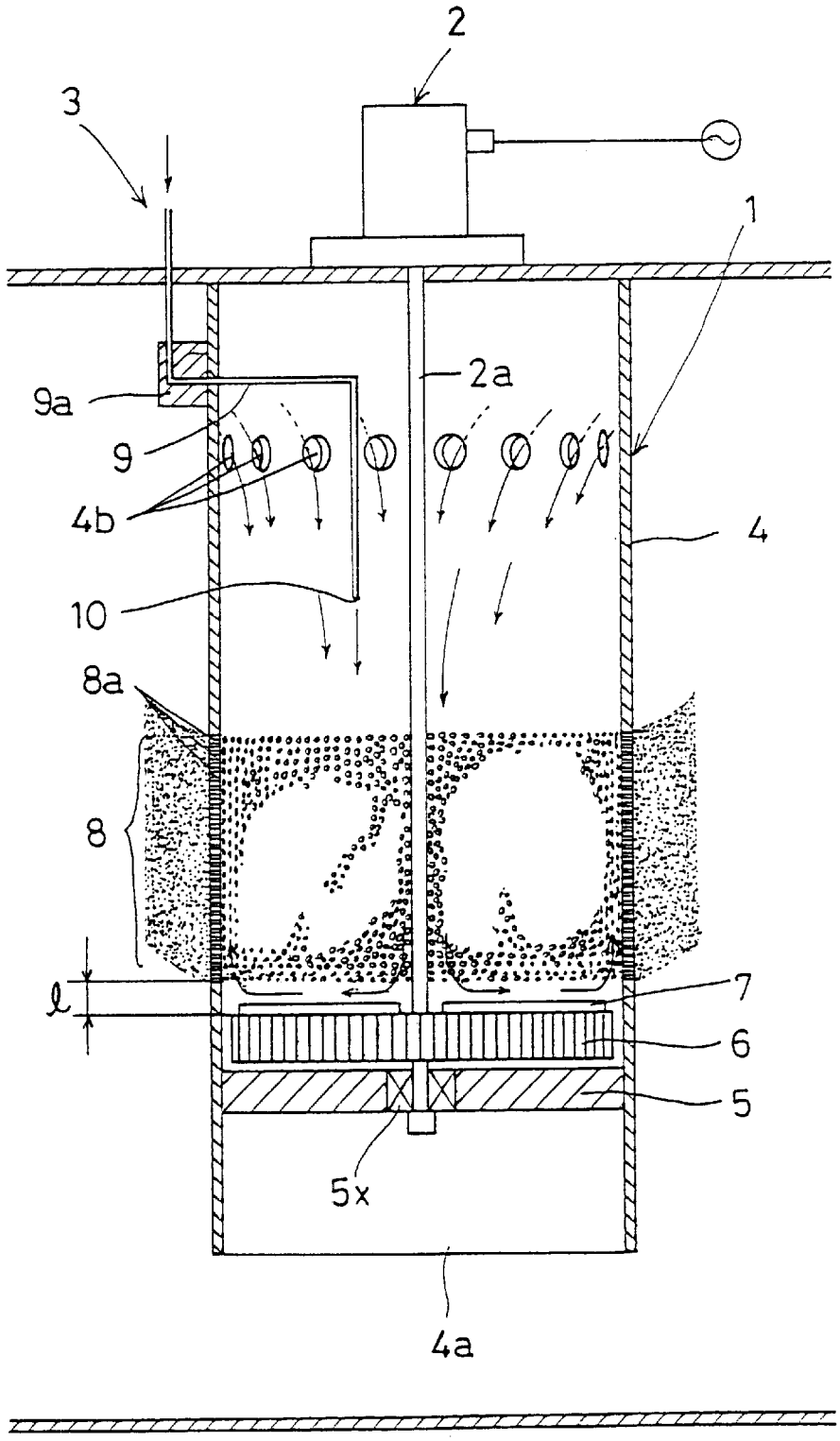
FIG. 4 is a sectional view of a third embodiment.

In FIG. 4, another bubble mixing device of a third embodiment is shown. In this embodiment, what differs is that the mounting position of the rotary vane 6 and their mounting seat 5 is reversed with respect to the first embodiment to supply water and gas from above. Thus, a plurality of water passing holes 4*b* for introducing water are provided like in the second embodiment, and the gas supply pipe 9 is also provided above.

The operation of this embodiment is basically the same, though the water flow and the gas flow are, contrary to the first embodiment, from above toward the rotary vane, so that the description is omitted. Although the bottom end of the mixing cylinder 4 is open at the opening 4*a* in this embodiment, it will be needless to say that the opening 4*a* may be closed by an end plate.

Figure 5:
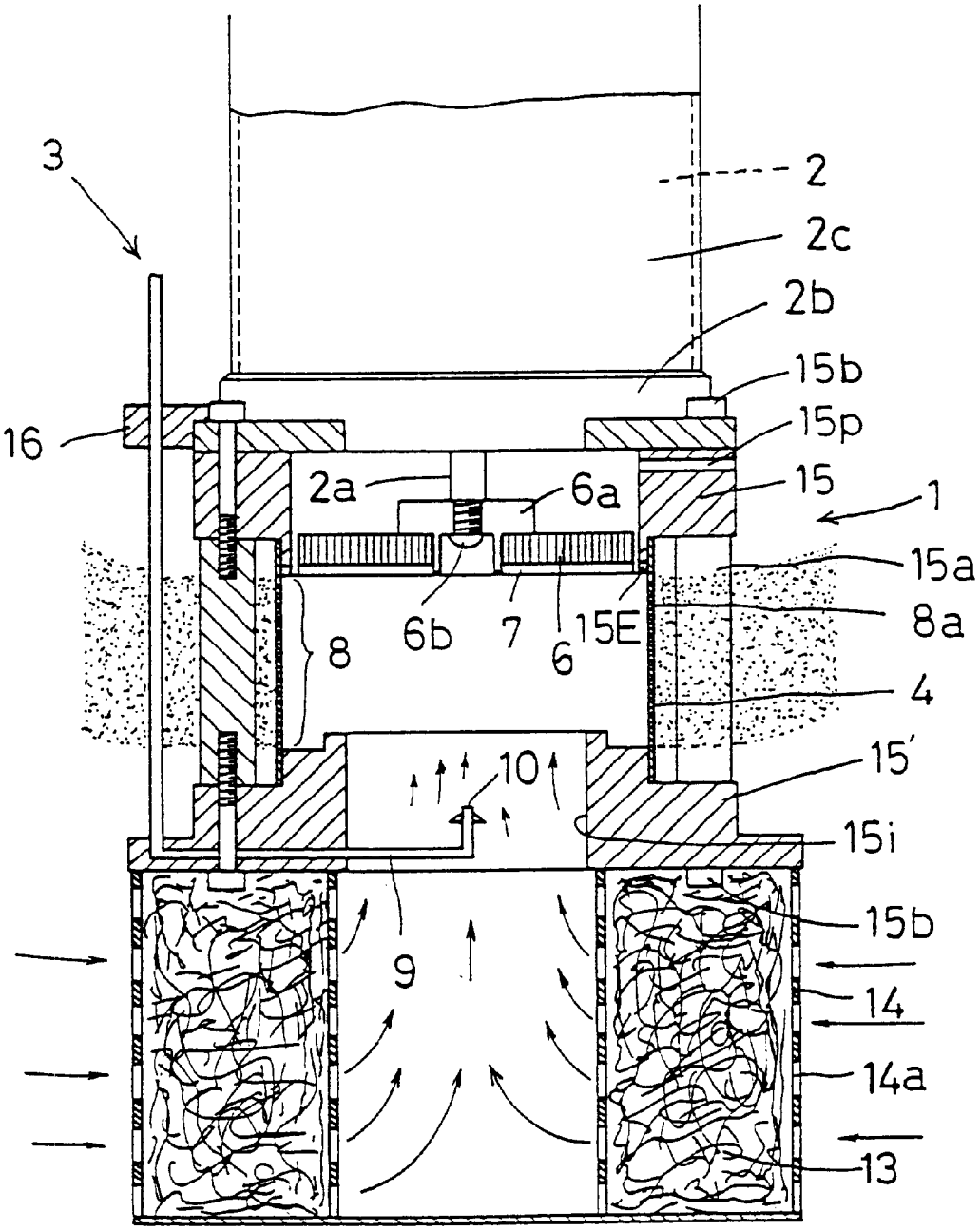
FIG. 5 is a sectional view of a fourth embodiment.

In FIG. 5, a sectional view of the gas/liquid mixing device of the fourth embodiment is shown. It is provided with a gas/liquid mixing cylinder 4, a drive unit 2 and a gas supply means 3 as in the first embodiment. But specific shapes of the respective means are slightly different. Although it is the same in that it is used in water, it is different in that it can be used in water by using a submersible pump as the drive unit 2. The drive unit comprises a motor 2*c* mounted in an outer case, and has its flange 2*b* at the bottom end placed on a support plate 15. The motor 2*c* has an output shaft 2*a*.

Figure 6:
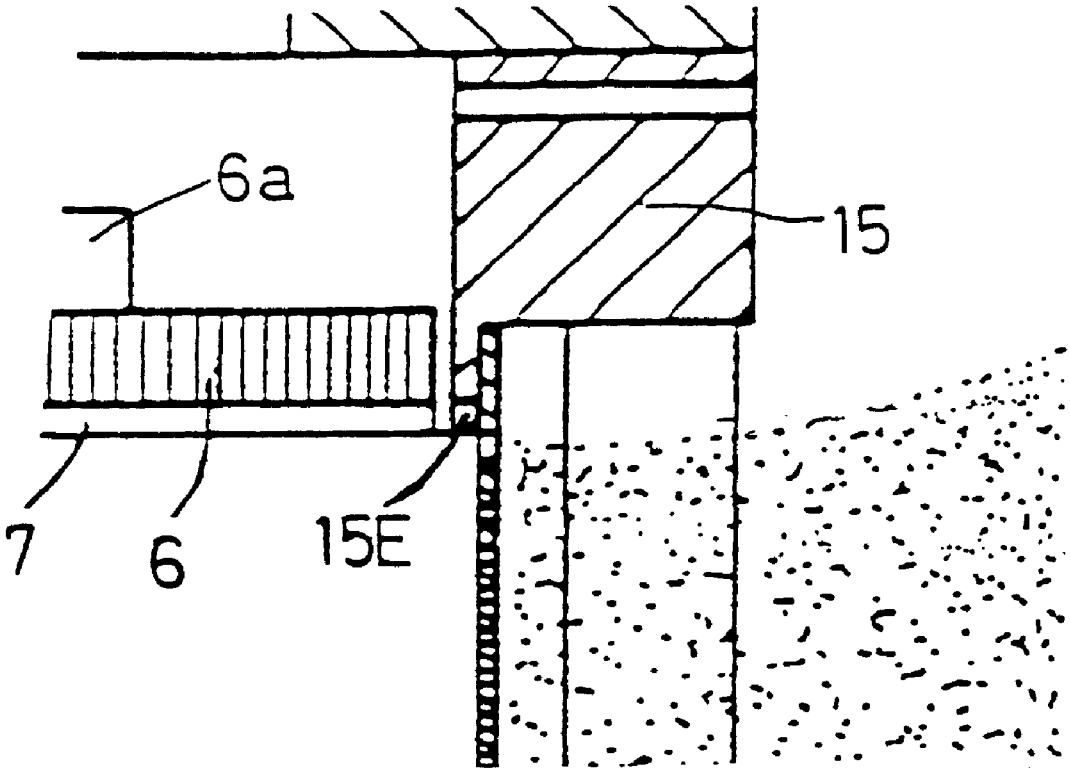
FIG. 6 is an enlarged sectional view showing how the edge member is attached.

Under the support plate 15, a lower support plate 15' is provided. Both support plates 15 and 15' are clamped by bolts 15*b* at a constant distance, and the flange 2*b* of the motor 2*c* is also fixed by the bolts 15*b*. A plurality of support pillars 15*a* are mounted at suitable angular intervals. The support plate 15 is formed circular as a whole. An edge member 15E is secured to the bottom of its inner peripheral end (FIG. 6). Opposite this edge member 15E, a mixing cylinder 4 in the shape of a hollow cylinder is provided against one of steps of the support plate 15' formed with several steps.

The mixing cylinder 4 has a multiplicity of bubble dispersing holes 8*a* formed in a thin cylindrical plate over a bubble dispersing region 8. The holes 8*a* are drilled in a thin plate what is called a punching metal. The cylinder 4 does not have strength enough to stably support members under the lower support plate 15'. Thus it is supported by the support pillars 15*a* and the mounting bolts 15*b*.

Inside of the edge member 15E of the support plate 15, a rotary vane 6 is coupled to the end of the output shaft 2*a* of the motor 2*c* so as to be rotated. It is mounted to the output shaft 2*a* by inserting a bolt 6*b* into a hole formed in a boss portion 6*a* provided at its central portion. At the bottom end face of the rotary vane 6, a guide vane 7 as shown in FIG. 2 is provided so that the bottom end of the edge member 15E is substantially aligned with the bottom of the guide vane 7. In the support plate 15, a hole 15*p* for bubble discharge is formed at a suitable position.

The lower support plate 15' is, as shown, flange-like having its outer periphery formed into steps, and is formed with a hole 15*i* having a predetermined diameter at its center. Also, in the radial direction from an arbitrary position of the outer periphery, a gas supply pipe 9 for supplying air or ozone-containing air is mounted so that an opening 10 at its tip is directed toward the center of the rotary vane 6.

At the bottom of the support plate 15', a filter member 13 is mounted. It is inserted in a doughnut-shaped filter case 14, which has numerous punched holes 14*a* drilled in its outer and inner peripheral surfaces and also has its lower bottom closed. Thus, it is formed such that sucked water passes through the holes in the outer and inner peripheral walls of the filter case 14 and its central hollow portion, and flows upward through the hole 15*i* of the support plate 15'.

The gas supply pipe 9 of the gas supply means 3 has its intermediate portion fixed to the side of the flange 2*b* by a retaining member 16. The gas supply means 3 is provided in the same manner as in the first embodiment. Also, while this gas-liquid mixing device is also used so as to stand upright in a water tank A, it is a matter of course that it can also be used submerged in water other than in the water tank A.

Since the operation of the gas/liquid mixing device of this embodiment is basically the same as in the first embodiment, description of the basic operation is omitted. Operation inherent to this embodiment will be described. When the rotary vane 6 is rotated, since the water current formed is moved in a radial direction by the guide vane 7, a water current is formed that passes through the hole 15*i* of the support plate 15' and flows upwardly. This is the same as in the first embodiment.

This water current moves upwardly through the hole 15*i* while the filter member 13 removes large pieces of debris and foreign matter which are contained in water sucked from outside, and bubbles supplied from the gas supply pipe 9 are mixed. It then moves toward the rotary vane 6 in a spiral manner along the axis of the rotary vane 6. By centrifugal force produced by rotation of the guide vane 7, it is scattered in a radial direction and collides hard against the edge member 15E at the bottom of the support plate 15. Thus, the bubbles contained in the water current are ripped up and pulverized into ultrafine ones.

In this embodiment, the edge member 15E has a width corresponding to the width of the guide vane 7. This width serves as a dead zone. Thus, by collision against the edge member 15E in the dead zone, ultra-fine bubbles are produced. These bubbles move downwardly together with the water current, exit out of the bubble dispersing holes 8*a* of the mixing cylinder 4, and disperse in external water.

While the function of dispersing ultra-fine bubbles in water in the manner described above is substantially the same as in the first embodiment, large bubbles are taken out through the bubble vent 15*p* provided in the support plate 15 in this embodiment. A slight gap is provided between the outer peripheral surface of the rotary vane 6 and the edge member 15E. Through this gap, relatively large bubbles rise into the space above the rotary vane 6. This is because when the gas/liquid mixing device of this embodiment is operated for a long time, relatively large ones among bubbles supplied from the gas supply pipe 9 of the gas supply means 3 move into the space.

If such bubbles remain in the space above the rotary vane 6, they may corrode the rotary vane and the inner peripheral wall of the support plate 15. Thus, such bubbles are discharged outside through the bubble vent 15*p*. Since bubbles discharged outside are large in buoyancy, when they come out into external water, they rise due to their buoyancy and are discharged into the outer air. If the water tank A is used, by forming holes in the top plate, they are spontaneously discharged through them into the outer air.

The gas/liquid mixing device of this invention has a gas/liquid mixing cylinder and a gas supply means. Gas and liquid are mixed and compressed by the mixing/compressing means in the mixing chamber, and bubbling water is dispersed through the bubble dispersing holes at the bubble dispersing area. Thus, it is possible to form bubbles that are so small as to be invisible to the eye, dissolve the bubbles into water in a short time. The solubility can be improved greatly.

What is claimed is:

1. A mixing device for mixing gas into a liquid, said mixing device comprising:

a mixing cylinder having a peripheral wall that has a radius and an axial length, said mixing cylinder being submerged in the liquid;

a gas supply device for supplying gas into said mixing cylinder, said gas supply device comprising a gas supply port located in said mixing cylinder so as to be submerged in the liquid;

a mixing/compressing device, provided in said mixing cylinder, for compressing a gas/liquid mixture; and a driving unit, coupled to said mixing/compressing device, for driving said mixing/compressing device;

wherein said mixing cylinder includes a bubble dispersing area provided for a first predetermined axial distance along said axial length of said mixing cylinder, said bubble dispersing area being spaced from said mixing/compressing device by a second predetermined axial distance, said bubble dispersing area comprising a plurality of through-holes in said peripheral wall of said mixing cylinder, wherein said mixing/compressing device and said driving unit are arranged so as to mix gas into the liquid in the form of bubbles, and wherein said first predetermined axial distance of said bubble dispersing area, said mixing cylinder and said mixing/compressing device are arranged so as to compress, atomize, and discharge the bubbles via said through-holes out of said mixing cylinder.

2. The gas/liquid mixing device as claimed in claim 1, wherein said mixing/compressing device is a rotary vane having guide vanes for moving liquid in a radial direction.

3. The gas/liquid mixing device as claimed in claim 2, wherein said gas supply port is disposed at an opposite side of said rotary vane relative to said driving unit.

4. The gas/liquid mixing device as claimed in claim 1, wherein said gas supply port is disposed at the same side of said rotary vane as said driving unit.

5. The gas/liquid mixing device as claimed in claim 1, further comprising:

an upper support plate having a bottom;

a lower support plate;

upper and lower mounting devices for mounting said mixing cylinder to said upper and lower support plates, respectively; and an edge member located at the bottom of said upper support plate.

6. The gas/liquid mixing device as claimed in claim 1, wherein said mixing cylinder comprises at least one a liquid passing hole for permitting liquid to pass through said peripheral wall into said mixing cylinder.

7. The gas/liquid mixing device as claimed in claim 6, wherein said at least one liquid passing hole is disposed on an opposite side of said mixing/compressing device relative to said bubble dispersing area.

8. The gas/liquid mixing device as claimed in claim 6, wherein said mixing/compressing device is disposed on an opposite side of said bubble dispersing area relative to said at least one liquid passing hole.

9. The gas/liquid mixing device as claimed in claim 1, further comprising a filter for filtering liquid supplied to said mixing/compressing device.

10. The gas/liquid mixing device as claimed in claim 9, wherein said filter comprises a hollow annular case and a filter member, a wherein said hollow annular case having a plurality of holes that communicate from outside of hollow annular case to the inside of the hollow annular case, and wherein said filter member is disposed within said hollow annular case.

* * * * *